US008381325B2

(12) United States Patent
Tassone, Jr. et al.

(10) Patent No.: US 8,381,325 B2
(45) Date of Patent: Feb. 26, 2013

(54) MODULAR POOL SYSTEM

(75) Inventors: George Tassone, Jr., Albrightsville, PA (US); Serge Dubeau, Plymouth, MN (US); Serge Provost, St-Laurent (CA); Richard Mark Sobel, Old Field, NY (US)

(73) Assignee: Wilbar International, Inc., Hauppauge, NY (US)

( * ) Notice: Subject to any disclaimer, the term of this patent is extended or adjusted under 35 U.S.C. 154(b) by 645 days.

(21) Appl. No.: 12/533,657

(22) Filed: Jul. 31, 2009

(65) Prior Publication Data

US 2010/0031434 A1 Feb. 11, 2010

Related U.S. Application Data

(60) Provisional application No. 61/086,320, filed on Aug. 5, 2008.

(51) Int. Cl.
*E04H 4/00* (2006.01)

(52) U.S. Cl. ..... 4/506

(58) Field of Classification Search ..... 4/506
See application file for complete search history.

(56) References Cited

U.S. PATENT DOCUMENTS

| | | | | |
|---|---|---|---|---|
| 4,823,858 | A * | 4/1989 | Perutz | 160/135 |
| 5,231,807 | A * | 8/1993 | Aymes | 52/65 |
| 6,647,562 | B1 * | 11/2003 | Arout et al. | 4/506 |
| 2004/0103472 | A1 * | 6/2004 | Marbach et al. | 4/506 |
| 2005/0241057 | A1 * | 11/2005 | Bonnin et al. | 4/506 |
| 2006/0031983 | A1 * | 2/2006 | Vultaggio | 4/506 |
| 2007/0266490 | A1 * | 11/2007 | Foy | 4/513 |
| 2008/0235996 | A1 * | 10/2008 | Evans et al. | 37/232 |

* cited by examiner

*Primary Examiner* — Lori Baker
(74) *Attorney, Agent, or Firm* — Hoffmann & Baron, LLP

(57) ABSTRACT

A modular pool system including a plurality of pivotally connected panels disposed side end to side end defining an enclosed pool perimeter wall. The panels are pivotable with respect to each other to form a pool perimeter wall configuration. A pool liner is secured to the pool perimeter wall for retaining water within the pool perimeter wall.

18 Claims, 19 Drawing Sheets

25
26
22
12
24

25
26
24
22
12
20
24

MODULAR POOL SYSTEM

This application claims the benefit of priority to U.S. Provisional Application Ser. No. 61/086,320 filed on Aug. 5, 2008, the contents of which are incorporated by reference herein in their entirety for all purposes.

FIELD OF INVENTION

The present invention relates generally to a swimming pool, and more particularly to a swimming pool formed from a modular wall system.

BACKGROUND OF THE INVENTION

Swimming pools include perimeter walls that are typically constructed of a ridged support frame having a continuous sheet metal wall attached about the periphery of the frame. The frame is comprised of vertical supports positioned at intervals around the sheet metal wall and attached at the base into a bottom channel or rail. A flexible pool liner is disposed within the wall and supported by the frame forming a basin to hold the water. The pool liner is secured at the top of the wall by a channel which is covered with a rail. The pools come in a variety of shapes with the various components being specific to a particular shape.

Swimming pools, including above-ground, semi-inground and inground pools, may also include a perimeter wall formed of a number of interconnected panels. The configuration of the pool perimeter wall is typically predetermined by the construction of the panels. For example, a pool having a round configuration will have panels specifically formed for this shape. Alternatively, if a pool has an oval shape various individual panels will be created in order to achieve this shape when they are attached to a support frame. Accordingly, the structural elements of the pool wall are specifically formed for a particular type of pool shape. This does not permit a pool installer to easily vary the shape when constructing the pool in order to accommodate an owner's desire or the physical constraints of the environment in which the pool is being assembled.

In addition, pools typically require a large number of specifically formed parts in order to create the outer perimeter wall. Accordingly, a manufacturer needs to provide each of these specialized parts and inventory same. Assembly of such pools typically requires a significant amount of time in order to locate, identify and assemble each of the specific parts.

Accordingly, it would be desirable to provide a swimming pool formed of a number of similarly formed modular components in order to simplify assembly. It would be further desirable to provide a pool system which permits the configuration of the pool to be adjusted upon installation.

SUMMARY OF THE INVENTION

The present invention provides a modular pool system including a plurality of pivotally connected panels disposed side to side defining an enclosed pool perimeter wall. The panels are pivotable with respect to each other to form a pool perimeter wall configuration. A pool liner is secured to the pool perimeter wall for retaining water within the pool perimeter wall.

The present invention also provides a modular swimming pool perimeter wall including a plurality of panels aligned side end to side end wherein adjacent panels are pivotally connected. The panels are rotatable relative to each other to form a pool wall configuration. A radius lock is disposed between adjacent panels to restrict rotation between adjacent panels to maintain the pool wall configuration.

The present invention further provides a method of installing a pool including:

obtaining a plurality of panels, the panels including joining members;

aligning the panels side end to side end;

pivotally connecting the panels together;

pivoting the panels with respect to each other to form a pool perimeter wall having a desired shape; and installing a member between connected panels to restrict rotational movement and fix the connected panels at a predetermined angle.

Figure 1:
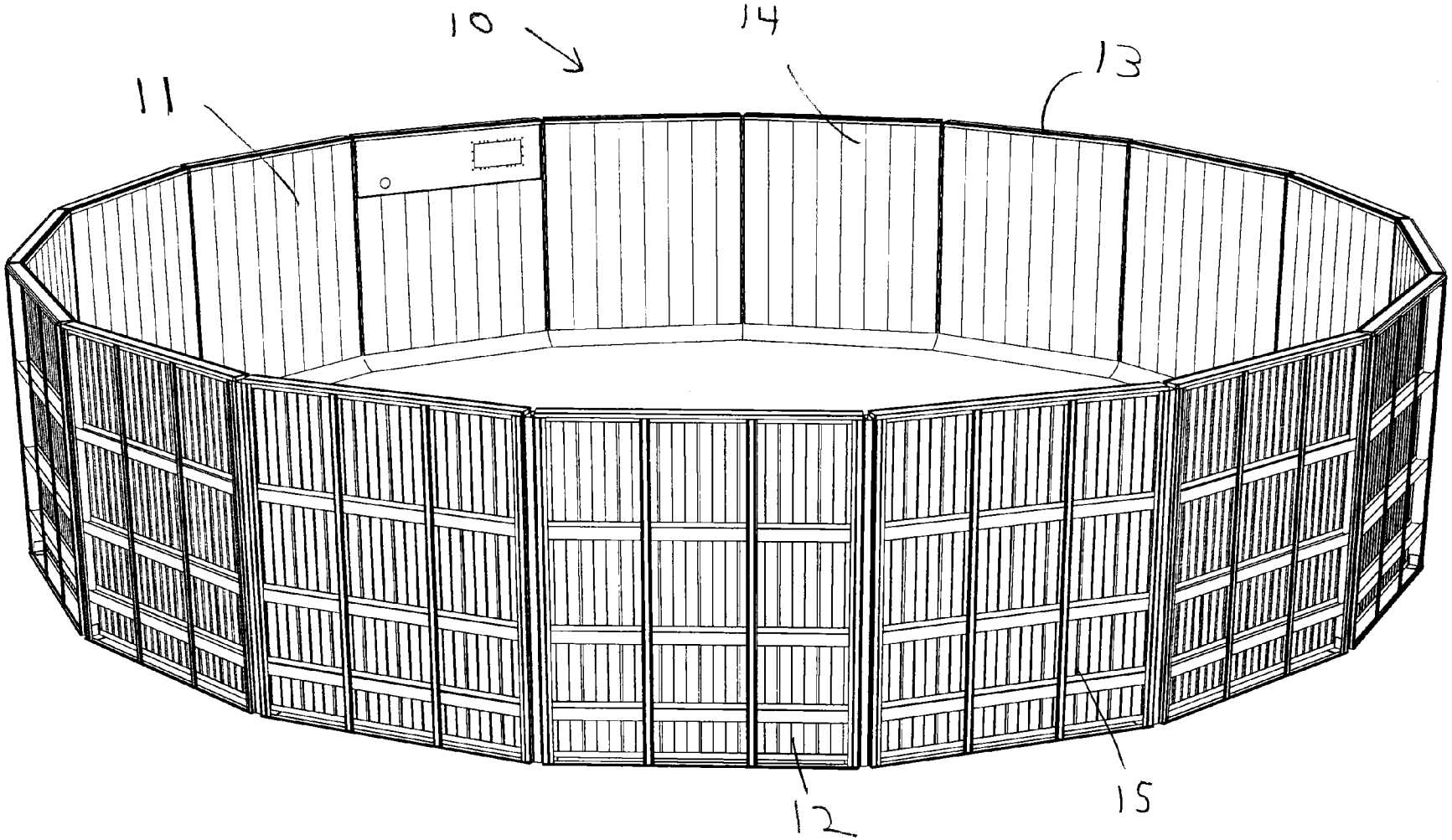
FIG. 1 is a top perspective view of a swimming pool formed using a modular system of the present invention with decorative panels removed.
Figure 2:
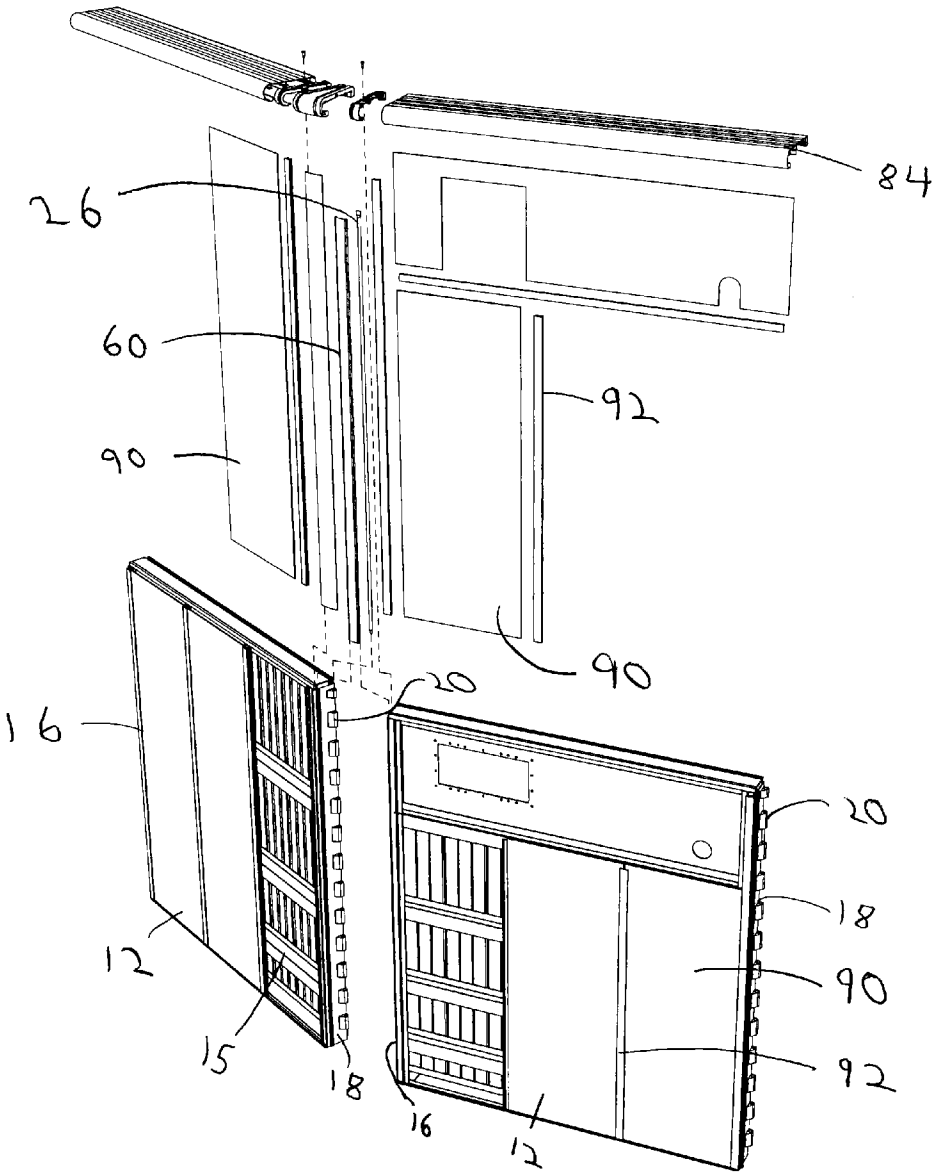
FIG. 2 is a detailed exploded view of two panels of FIG. 1.
Figure 3:
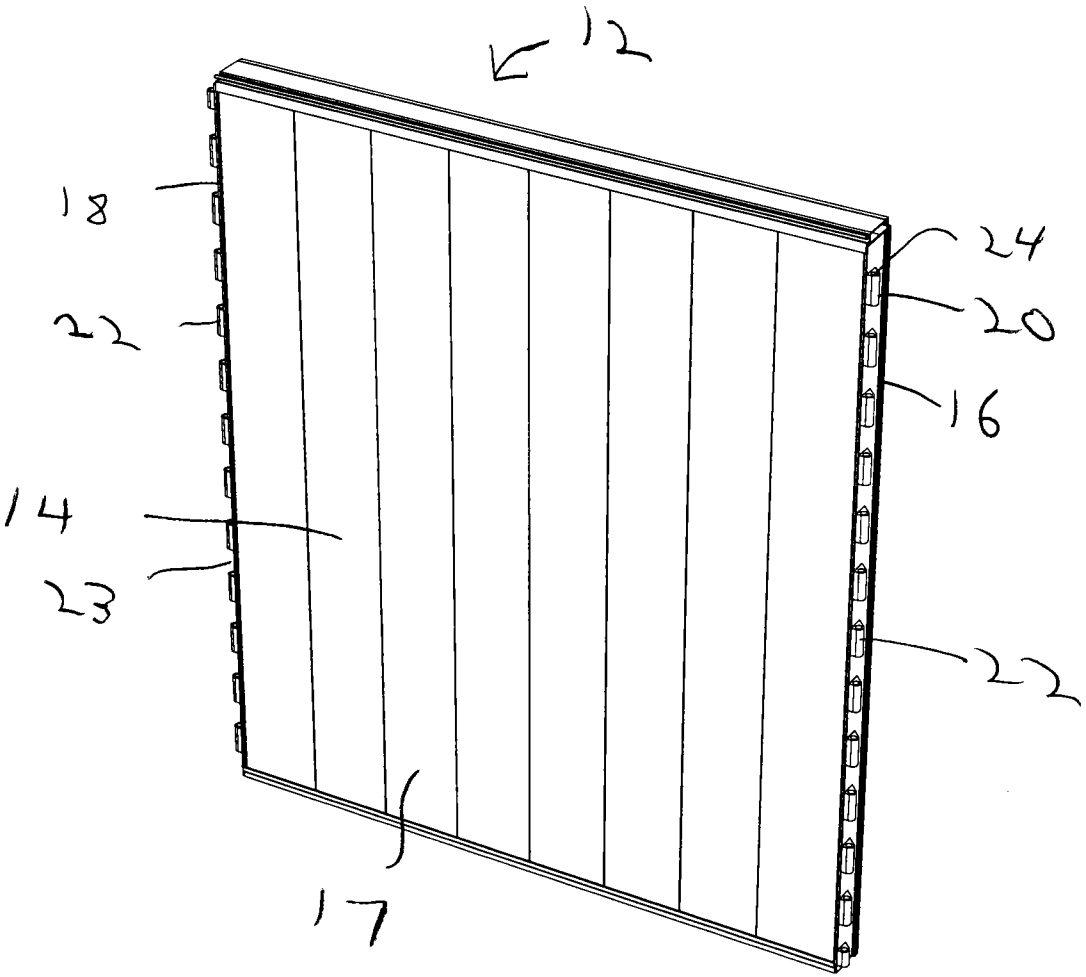
FIG. 3 is a perspective inner side view of a sidewall panel of the present invention.

DETAILED DESCRIPTION OF THE PREFERRED EMBODIMENTS:

With reference to FIGS. 1-3, a modular pool system 10 is shown. The modular pool system 10 includes a plurality of panels 12 interconnected to form a pool perimeter wall 13. The modular pool system 10 may be used to form above-ground, semi-inground, and inground pools.

Each of the panels 12 may be similarly formed and include an inner surface 14 which faces a pool interior 11 and an outer surface 15 which faces away from the pool interior. The panel 12 includes a body 17 and first and second side ends 16 and 18. The first and second side ends 16 and 18 may have disposed thereon a joining element 20 which engages a joining element 20 of an adjacent wall panel 12. A plurality of panels 12 may be aligned side end to side end and the side end of adjacent panels may be joined in order to form the perimeter wall 13. The panels 12, which are preferably similarly configured, may be formed of metal or may be molded from a plastic material.

Figure 4:
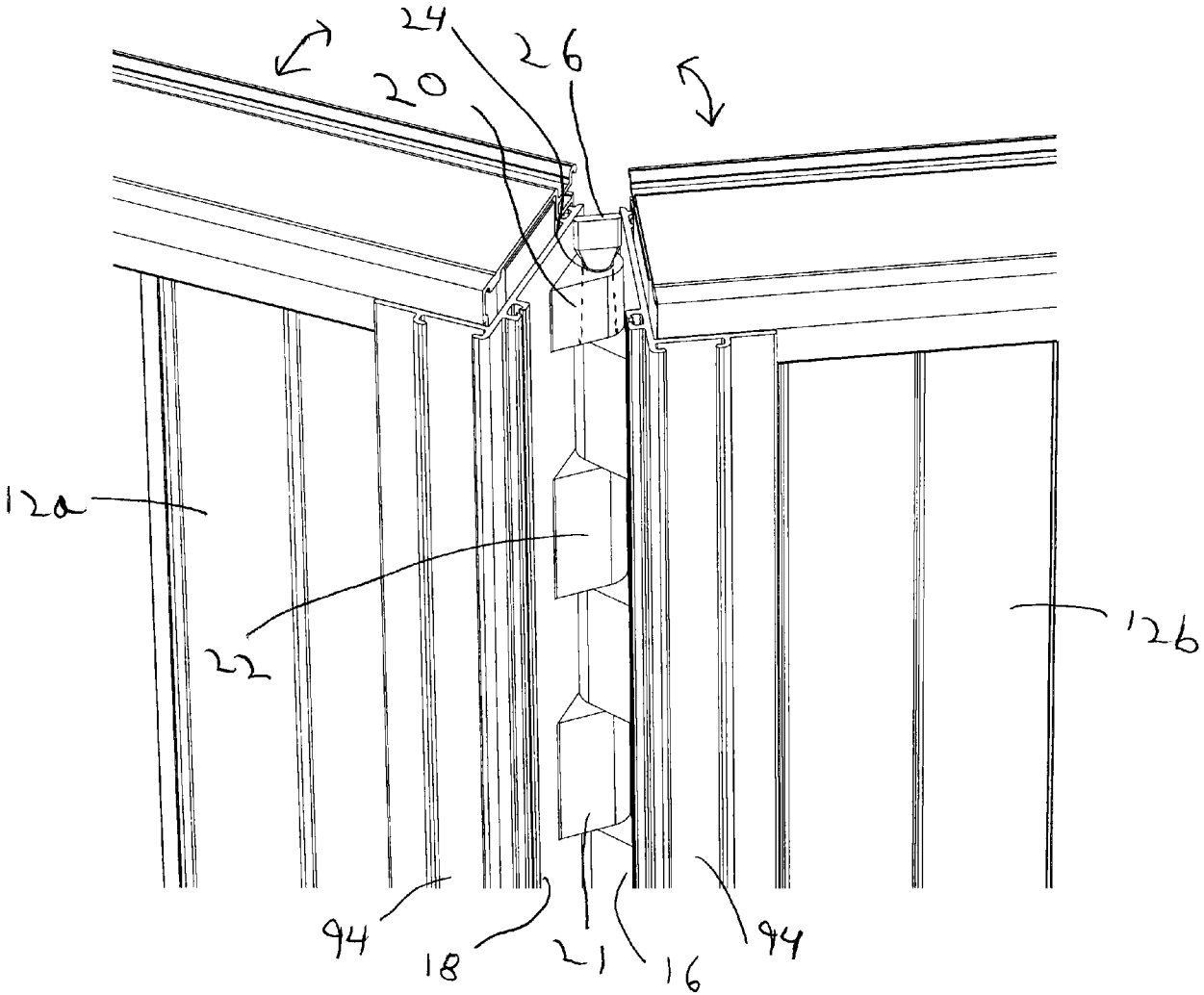
FIG. 4 is a perspective outer side view of two panels joined together.

With additional reference to FIG. 4, the joining elements 20 form a hinge 21 that permits the joined panels 12 to pivot with respect to each other. The joining elements 20 may include a linear array of spaced projections 22 extending outwardly from the first and second side ends 16 and 18. The spaced, generally lobe-shaped, projections 22 may be integrally formed with the panel body 17.The projections create a plurality of slots 23 there-between. The array of spaced projections of the first end 16 is offset from the array of spaced projections on the second end 18. Therefore, a first panel 12*a* may be connected to a second panel 12*b* by bringing into engagement the spaced projections 22 extending from the first side end 16 of one panel 12 with the spaced projections 22 extending from the second side end 18 of the other panel 12. Since the projections 22 extending from the first and second ends are offset, the projections of the second panel 12*b* will enter the slots 23 of the first panel 12*a* in an interleaving manner. The projections 22 may each include an aperture 24 extending there-through.

When the panels 12*a* and 12*b* are connected side end to side end, the projection apertures 24 of both panels align. A rod 26 forming a hinge pin may be inserted through the apertures 24, thereby pivotally retaining the panels 12 together. The rod 26 may be held in place by a friction fit. Alternatively, one end of the rod 26 may include threads (not shown) to engage threads formed in one of the projections 22. It is also within the contemplation of the present invention that other known means of pivotally attaching panels 12 may be used in order to join the panels 12 of the present invention.

Figures 4A, 4B:
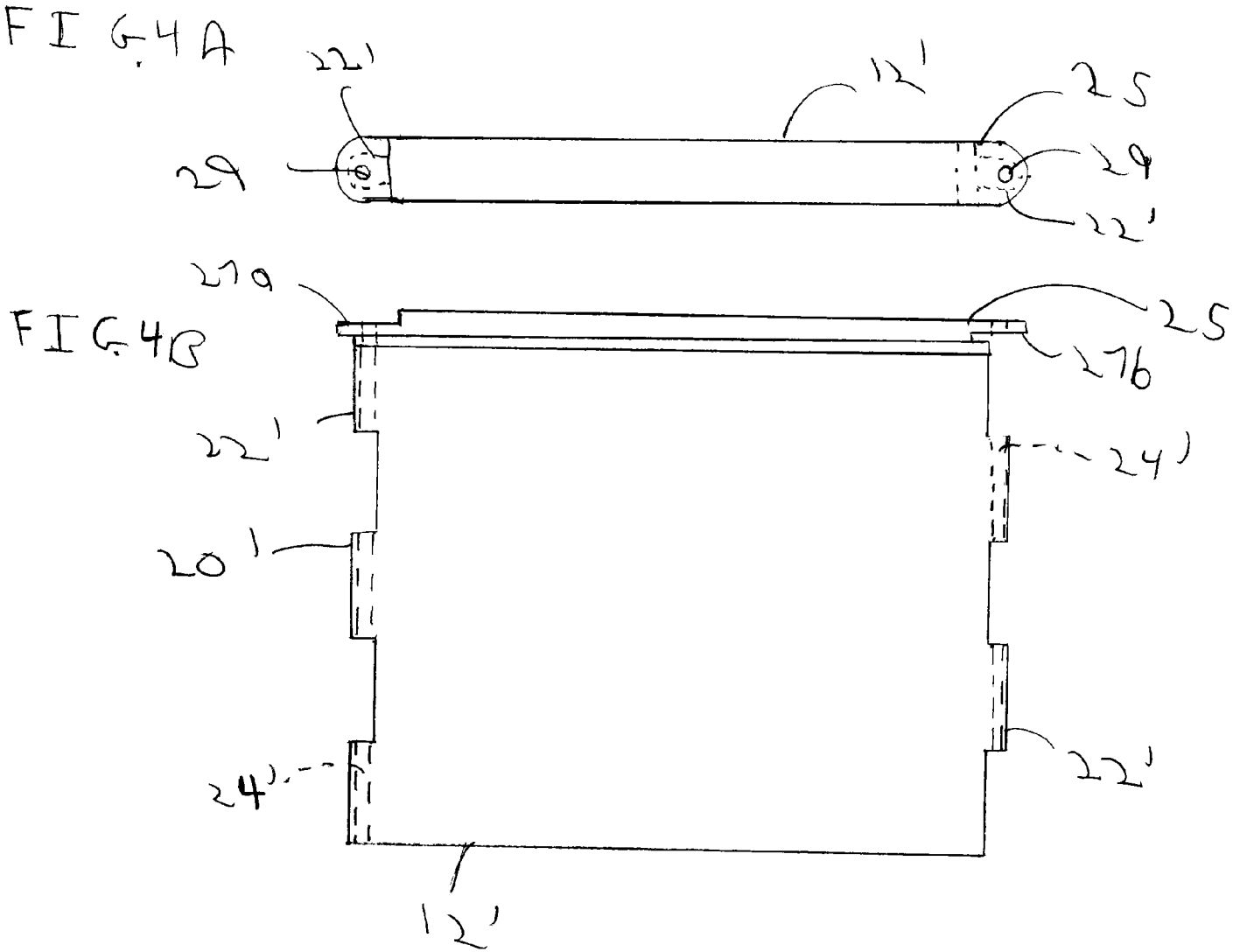
FIG. 4A is a top plan view of an alternative embodiment of the panel.
FIG. 4B is a front elevational view of the panel of FIG. 4A.

With reference to FIGS. 4A and 4B an alternative embodiment of the panel is shown. Panel 12' may include joining element 20' on the side ends. The joining elements 20' may include projections 22' having projection apertures 24' extending therethrough. The projections of a panel first side end are offset from the projections of a panel second side end. The first side end of one panel 12' may engage and be joined with the second side end of another panel 12'. Therefore, panels 12' may be joined to one another such that the projections 22' of adjacent panels interleave with each other forming a perimeter wall. The panel 12' may include a top plate 25 having stepped ends 27*a* and 27*b* which are the inverse of each other, such that the stepped end 27*a* of one panel 12' may be coupled to the stepped end 27*b* of an adjacent panel 12'. The stepped end may include openings 29 such that a rod may pass therethrough and through aligned apertures 24' of the joined panels 12'. Accordingly, a pivotable connection is formed between the joined panels 12'.

In the modular pool system of the present invention, all of the panels 12 used to form the perimeter pool wall 13 are preferably generally the same. Some panels may be modified to include openings to accommodate pool apparatus such as skimmers, returns, lights and cleaning systems. However, the overall size and shape are preferably the same. Accordingly, the manufacturing process is simplified. In addition, the hinged connection between the wall panels which allows one panel to rotate virtually 180° with respect to an adjacent panel, allows for great flexibility in forming the configuration of the pool perimeter wall all with the use of one type of panel. Therefore, this modular feature greatly eases the manufacture, design, supply, inventory, and construction activities. It is within the contemplation of the present invention, that some of the panels of the modular pool system 10 may have differing configurations. For example, some of the panels may have a curved shape to form such sections as the rounded corners of a rectangular pool wall.

In forming the pool perimeter wall 13, or portions thereof, it may be desirable to attach the panels 12 directly to each other in the manner described above. Alternatively, with reference to FIGS. 5-8, and 13A, in forming certain portions of a perimeter pool wall 13, for example straight portions, a union post 30 may be disposed between and join adjacent panels 12. The union posts 30 may each include an elongate member having opposed side ends 32 and 34. Extending outwardly from the side ends are the joining elements in the form of spaced projections 36. The spaced projections 36 may be similar to those formed on the side ends of the panels 12. The spaced projections 36 on side end 32 may be configured to receive the projections 22 extending from the panel second end 18. The projections 36 on side end 34 may receive the projections 22 extending from the panel first end 16. Rods 26 may be inserted into the aligned projection apertures 24 to secure the panels to the union post 30. Accordingly, a union post 30 may join together the first side end 16 of one panel with the second side end 18 of a second panel in a pivotal manner.

Figure 7:
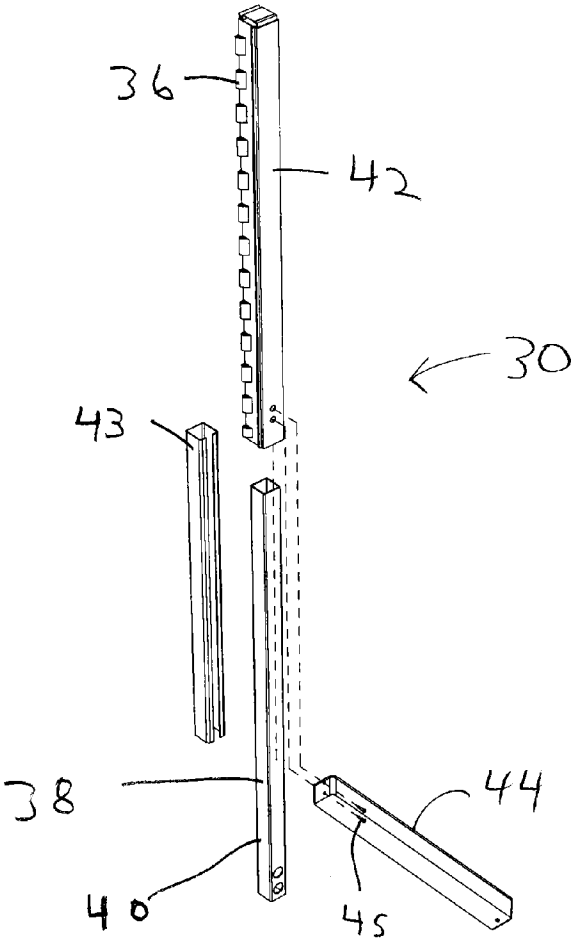
FIG. 7 is an exploded perspective view of a union post.
Figure 8:
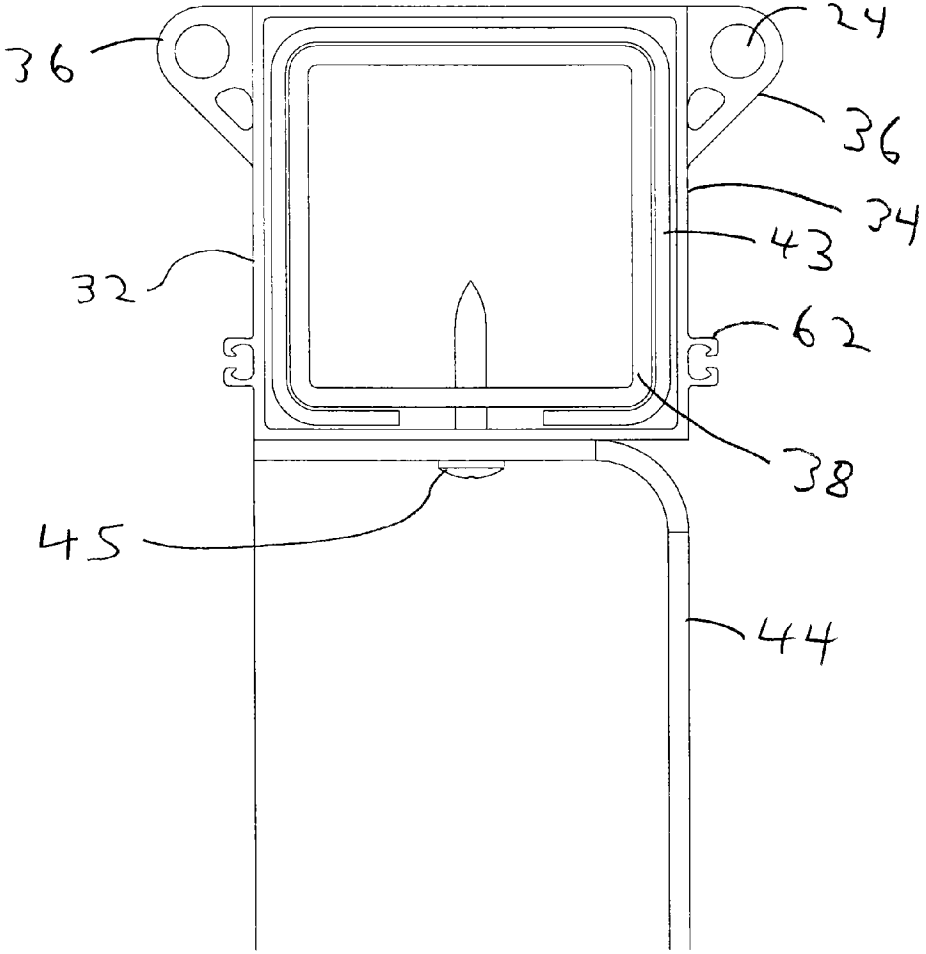
FIG. 8 is a top plan view of a union post.

With specific reference to FIGS. 7-8, the union posts 30 may include a shaft 38 which may be positionally fixed with respect to the ground upon which the modular pool system 10 sits. A shaft lower portion 40 may extend below the ground surface and be secured thereto permanently using cement or other material in a manner well known in the art. Accordingly, the position of the union post 30 is fixed. The union post 30 may also include a sleeve 42 extending over the shaft and secured thereto. The sleeve 42 may include the spaced projections 36 which attach to adjacent panels 12. A plastic sheath 43 may be interposed between the shaft 38 and the sleeve 42. The sheath 43 helps to isolate the sleeve 42 from the shaft 38. When the shaft and sleeve are made of different metals, the sheath 43 helps reduce corrosion due to galvanic action. A bracket 44 may be secured to the post 30 and extend generally orthogonally therefrom. The bracket 44 may be positioned such that it rests on the top surface of the ground when the post is correctly aligned. Bracket 44 aids in aligning the union post 30 in a vertically plumb orientation and also sets it at the proper height. This bracket 44 may be held to the post by screws or other fastening means 45 and may be removed therefrom after the concrete is set and the position of the post 40 is fixed.

Figure 6:
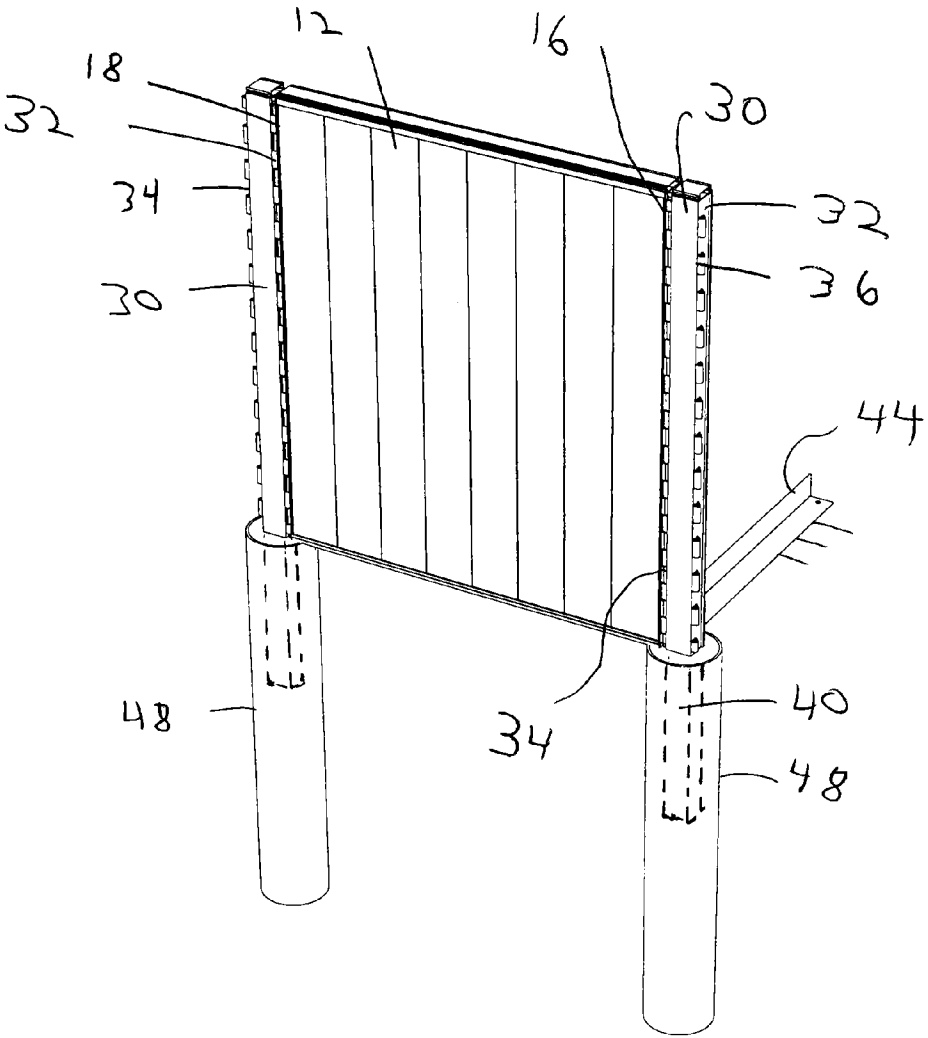
FIG. 6 is a top perspective view of a union post joined to a panel.

In order to fix the position of the union post 30, forms 48 may be placed in the ground and filled with concrete in a manner known in the art. (FIG. 6.) The lower end of the shaft 40 may then be set in the form 48. A series of union posts 30 may be spaced along a length of the pool perimeter wall 13 in situations where specific contour is desired. For example, if a straight section of the pool perimeter wall is desired, then the union posts 30 may be employed along the straight section. The union posts 30 will fix the ends of the panels 12 and prevent them from moving under the force of the water within the pool.

Figure 5:
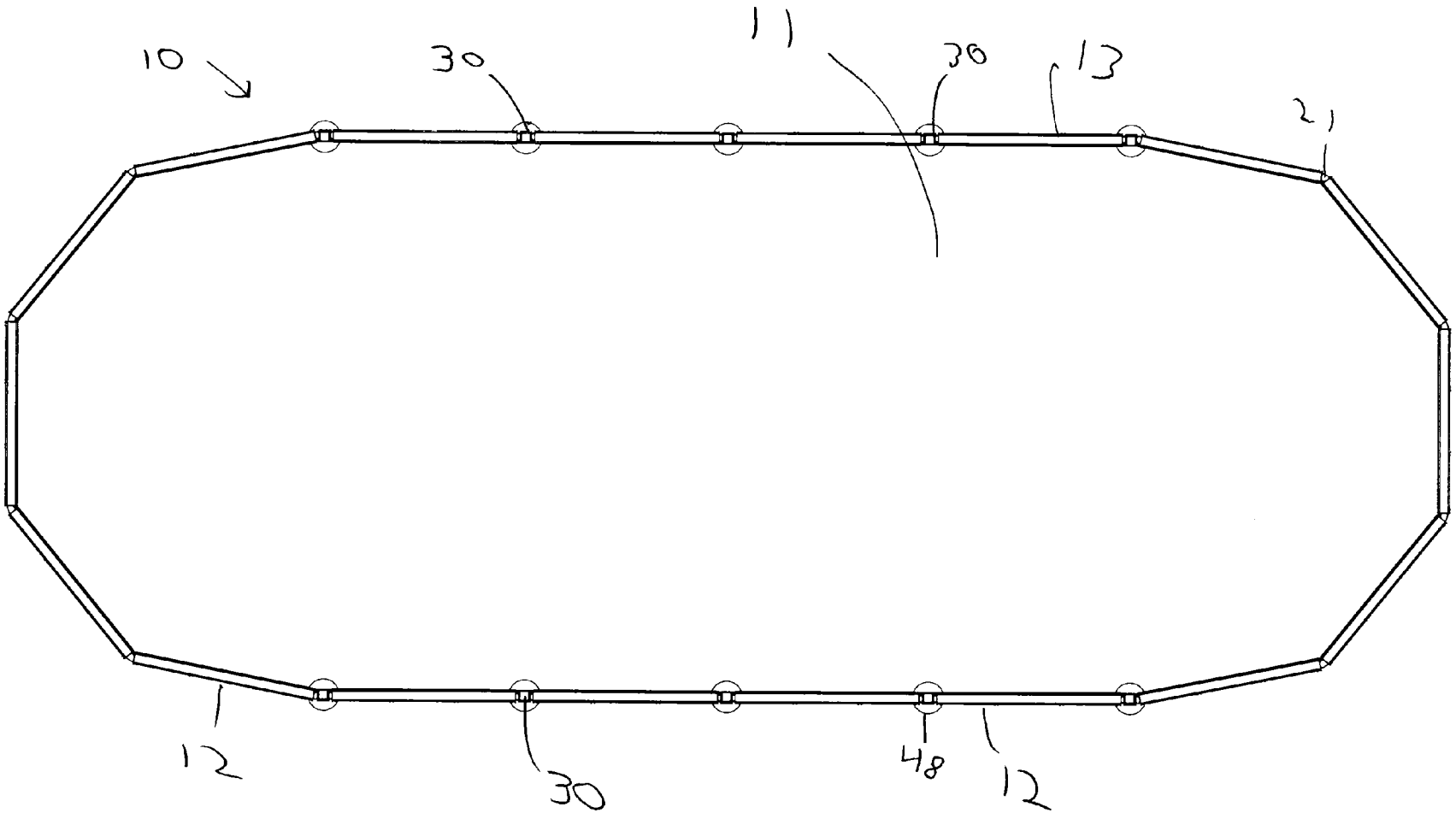
FIG. 5 is a top plan view of a pool perimeter wall.
Figure 9:
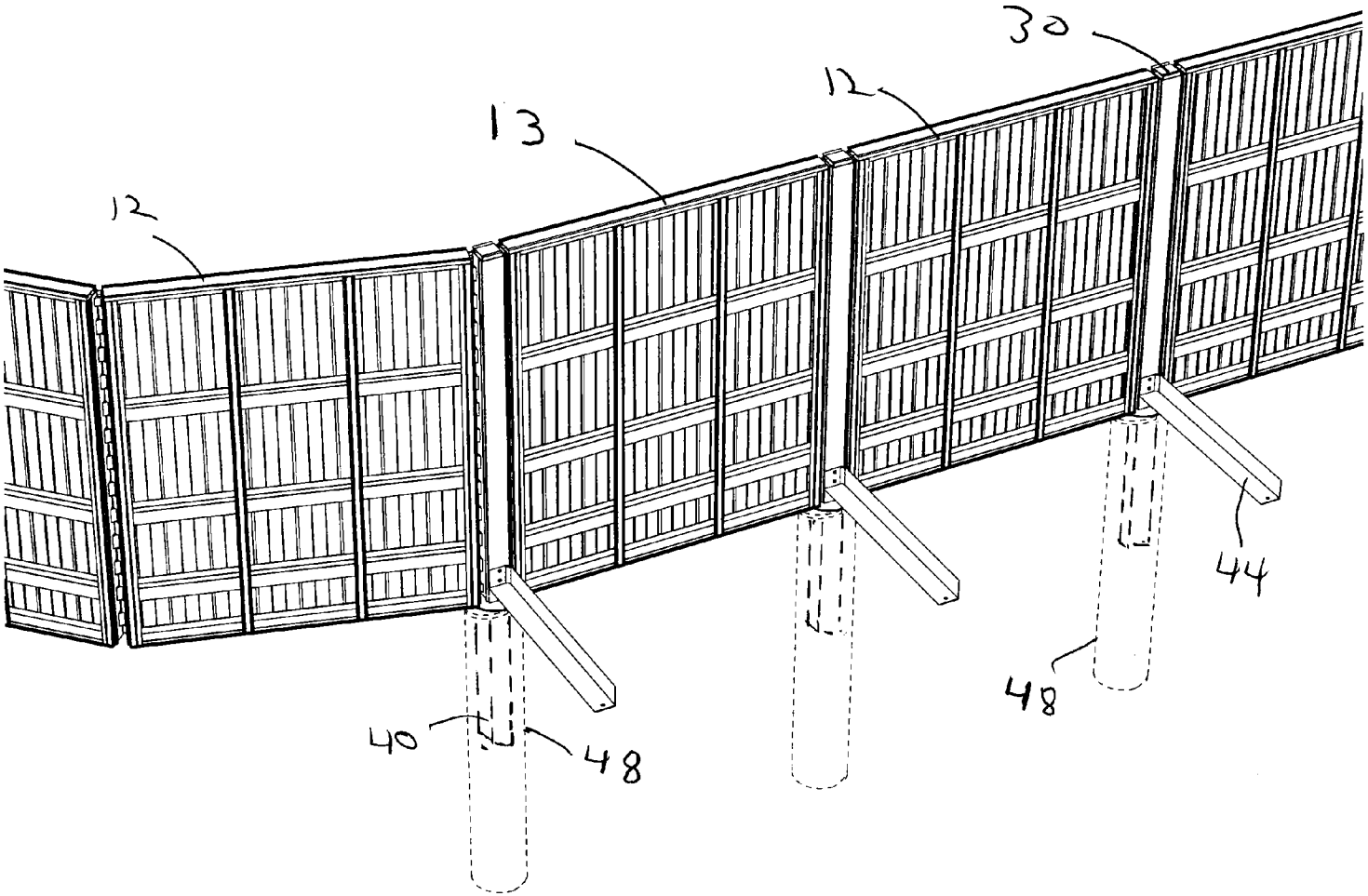
FIG. 9 is a perspective view of a portion of the perimeter wall including panels joined to union posts that are secured to the ground.

As shown in FIGS. 1, 5, and 9, in portions of the pool perimeter wall 13 which are to be rounded, such as the end of an oval or in a round pool, no such union posts are needed. The hinged wall panels 12 will tend to naturally assume a curved configuration due to the outward force of the water acting on the panels. Accordingly, in sections of the pool perimeter wall where the outward force of the water will provide the desired contour on the hinged panels, the union posts 30 are not needed. Union posts 30 could be used on such curved perimeter wall section if desired. However, where the configuration of a length of the perimeter pool wall is intended to resist the outward force of the water, it is desirable to use the union posts 30 in order to hold the configuration of the pool perimeter wall 13.

Figure 10:
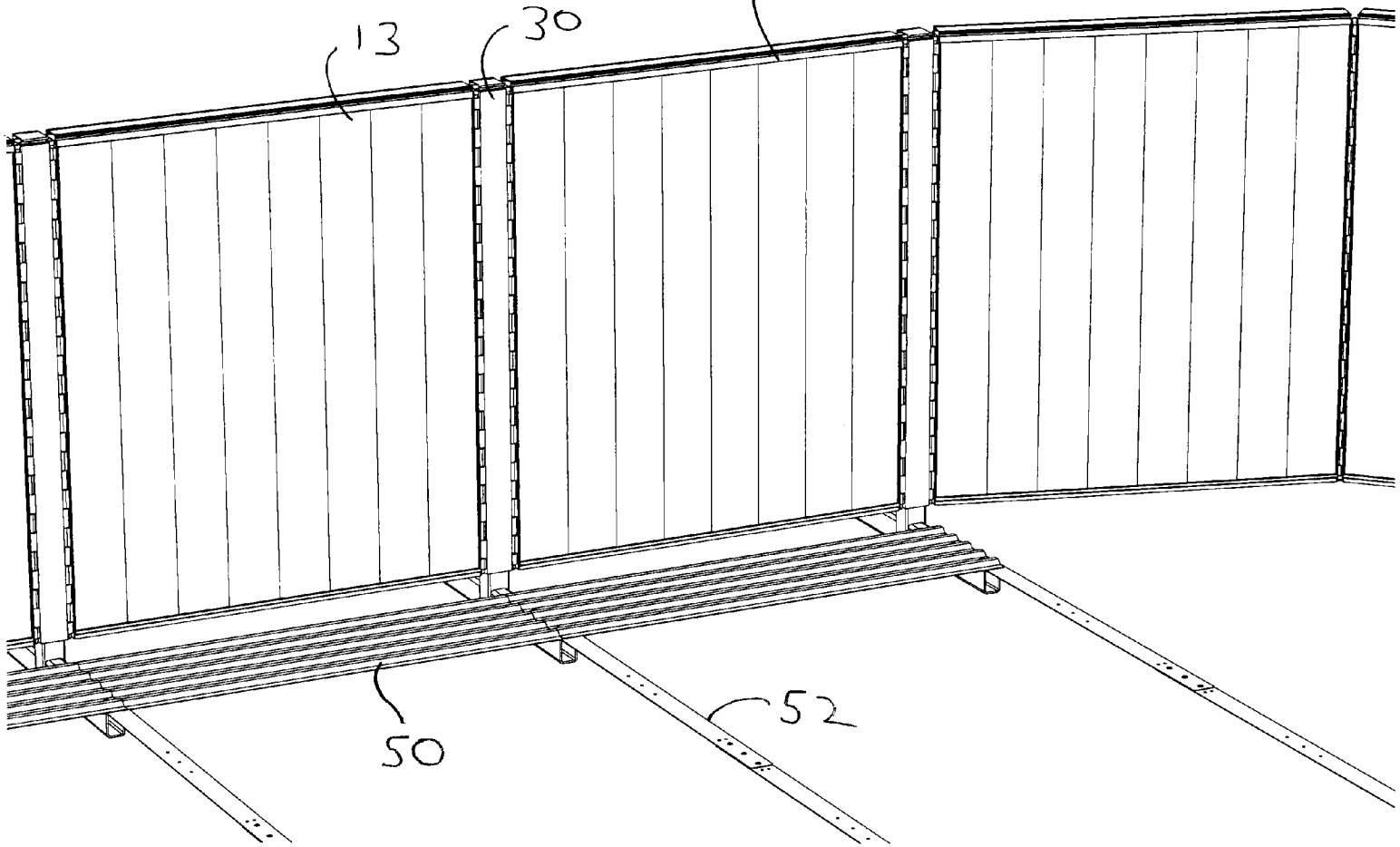
FIG. 10 is a perspective view of a portion of the perimeter wall including panels joined to union posts that are secured by a pressure plate and straps.

With reference to FIG. 10, in an alternative embodiment, in order to secure the position of the union posts 30, a pressure plate 50 extending along the base of the perimeter wall 13 may be employed. In this embodiment, there is no need for forms or concrete in order to secure the union post 30. The union post shaft, therefore, does not extend much below the sleeve. Instead the union posts 30 on one side of the pool are secured together by a pressure plate 50. Straps 52 may extend from the plate 50 across the pool interior to the plate 50 on the other side. The plate 50 and straps 52, therefore, prevent opposed panels 12 of the pool perimeter wall from moving away from each other. When water is introduced into the pool, the outward pushing force of the water against the force on the wall panels will be resisted since the plate prevents the wall panels from separating. The desired shape of the pool perimeter wall 13 is thereby maintained.

Figure 11:
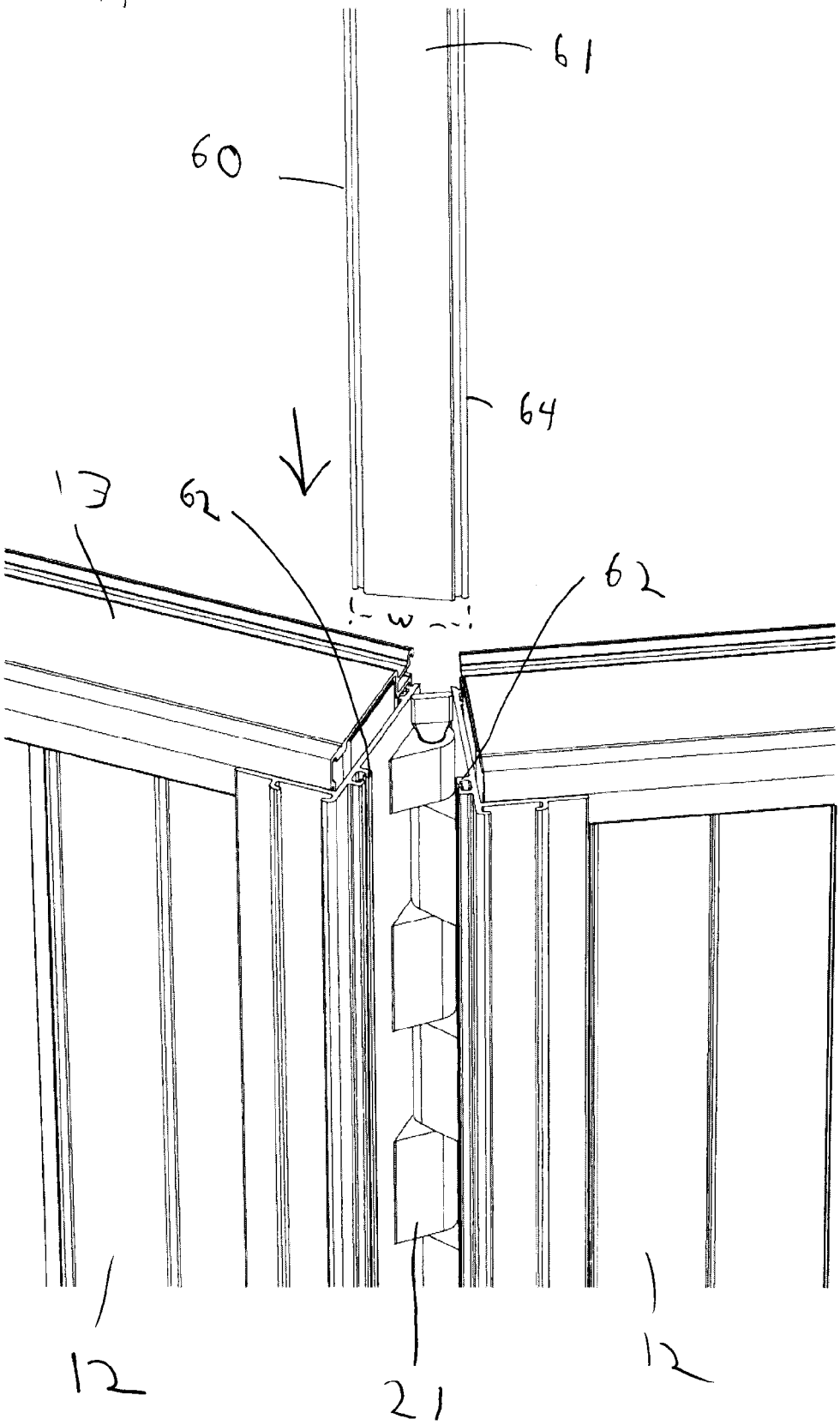
FIG. 11 is a partial exploded view showing a radius lock prior to insertion.
Figure 12:
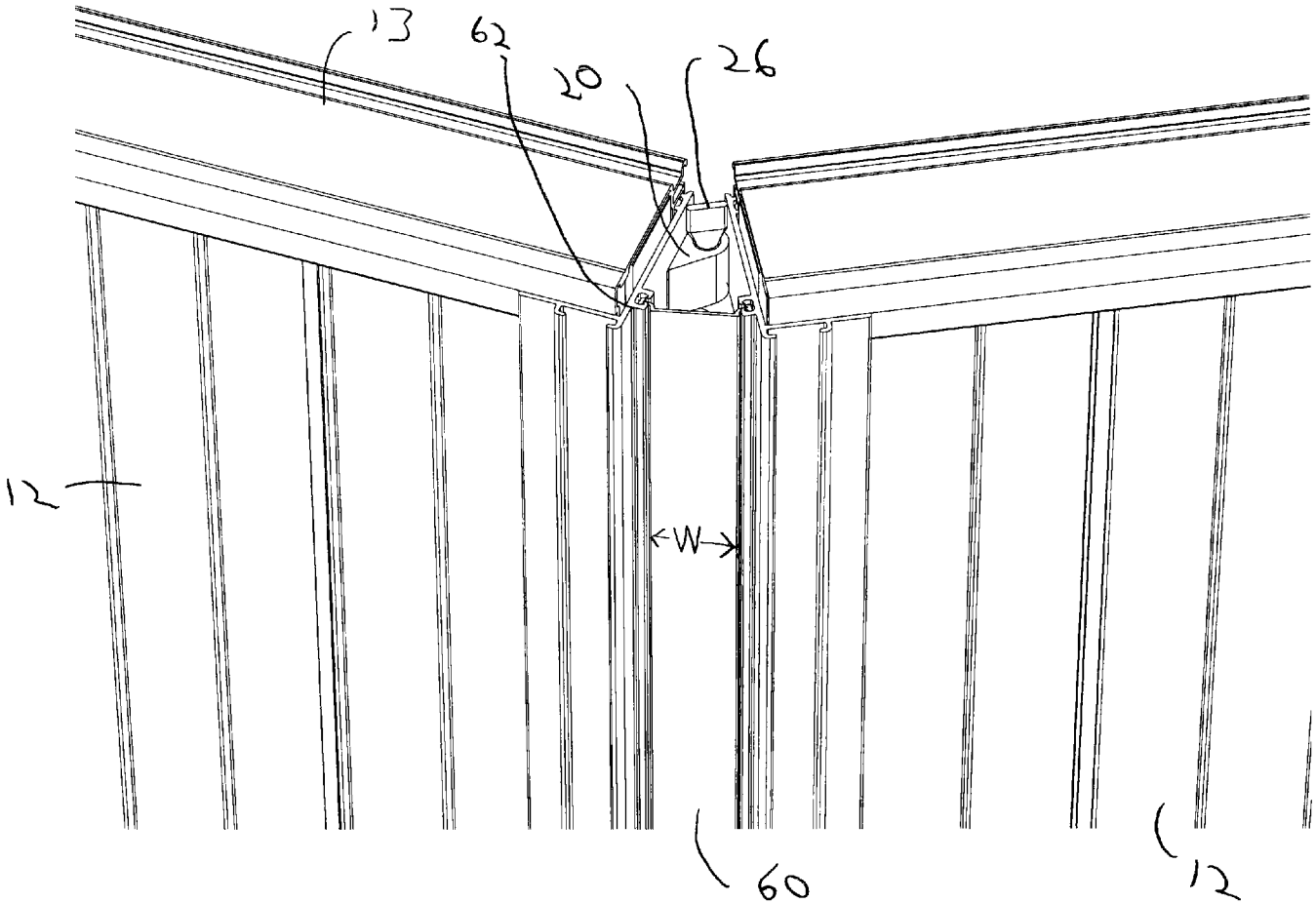
FIG. 12 is a perspective view of panels joined together with a radius lock installed.
Figure 13:
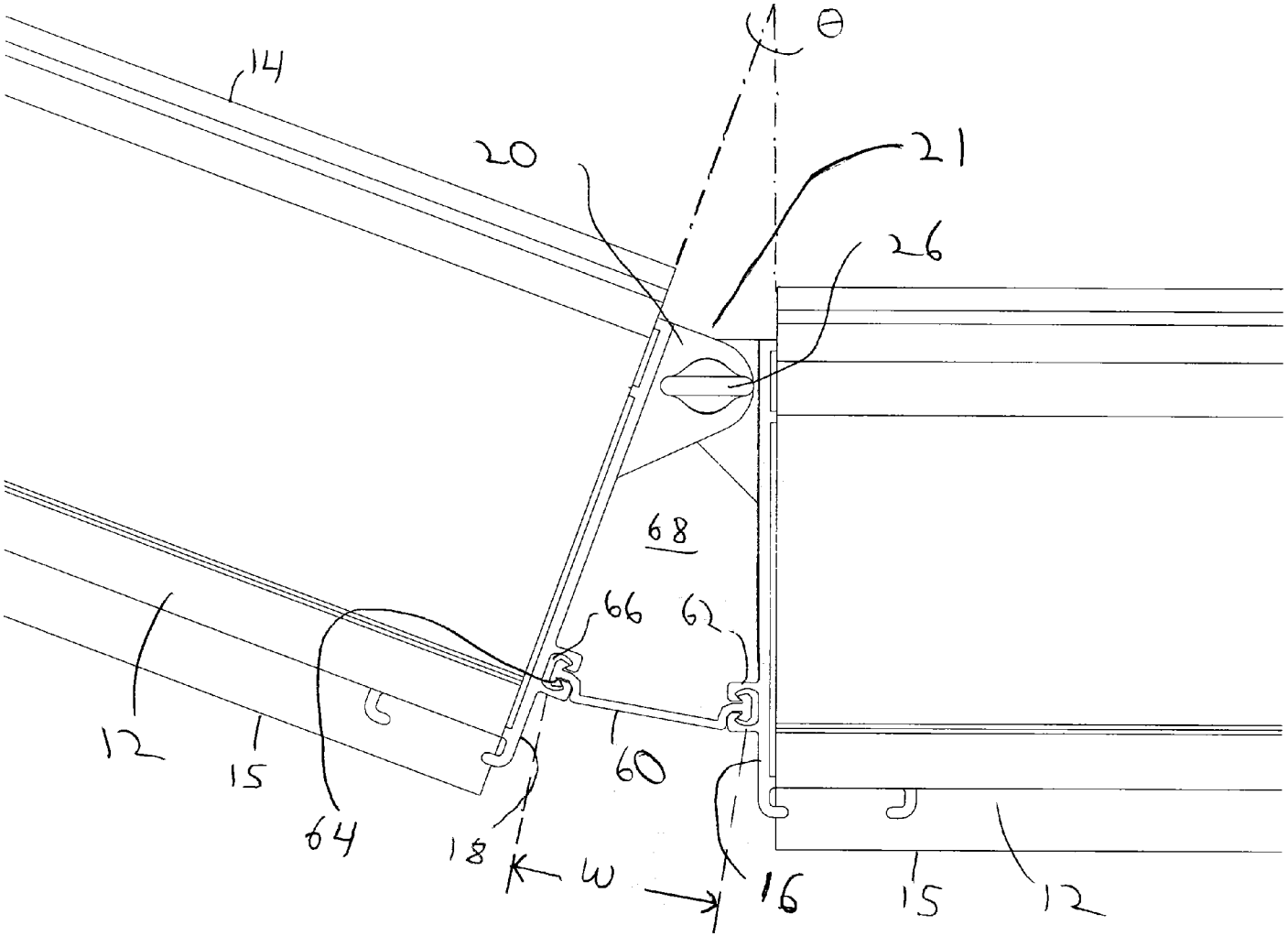
FIG. 13 is a top plan view of panels joined together to form a curved portion of a pool perimeter wall.

With reference to FIGS. 11-13, pool perimeter wall 13 may be designed having curvatures with a certain radius and may have straight sections. The ability to pivot the panels 12 with respect to each other provides a great deal of flexibility in designing pool perimeter walls. However, after the panels 12 have been properly positioned to form the desired configuration, it is desirable to fix the angular position of the panels relative to each other. Fixing the angular position of the panels 12 prevents them from being moved out of place during the completion of installation and filling of the pool with water. Accordingly, radius locks 60 are provided which may be inserted between adjacent panels 12 to set and maintain the angle between them.

The radius lock 60 may include a ridged structure securable between the adjoining panel side ends. The radius lock 60 may include a generally planar body 61 having opposed sides 64. The sides 64 may have a T-shaped cross-sectional profile. The first 16 and second 18 panel side ends may each include a radius lock securement member 62. The securement member 62 may include a channel 66 extending along the panel side end on which it is disposed. The channel 66 may have a generally C-shaped cross-sectional profile. The radius lock sides 64 may be slid along a longitudinal direction into the channels 66 until the radius lock 60 is disposed between the adjacent panels 12. The radius lock sides 64 and channels 66 may have interlocking profiles such that the radius lock 60 cannot be moved transversely from the panel side ends 16, 18. Accordingly, the radius lock resists inward rotation of the panels since the sides of the radius lock cannot be pulled out from the radius lock securement members 62 due to the interlocking profiles. The radius lock 60 also resists outward rotation of the panels since the panels 12 do not compress the radius lock 60. Accordingly, with the radius lock 60 in place, the panels 12 are prevented from rotating either inwardly or outwardly.

The panel joining elements 20 may be disposed on the side end adjacent the panel inner surface 14. The securement members 62 may be disposed adjacent the panel outer surface 15. When the panels 12 are rotated with respect to each other to form a curve, a space 68 between is created. The radius lock 60 extends across the space 68, as shown in FIG. 13. With the radius lock in place, adjacent panels 12 are connected to each other along their length at three spaced locations, namely, the hinge rod 26, the securement member 62 on first side end of one panel, and the securement member 62 on the second side end of the panel 12. Accordingly, the panels 12 are held together in a stable manner.

The width, w, of the radius lock 60 controls the set angle θ of the adjacent panels. Radius locks 60 may be provided in a variety of widths in order to allow for varying set angles θ to be achieved. For example, if the panels 12 are to be set for forming a 9 ft. radius curve, a first size radius lock 60 may be used. If the panels 12 are to be set to form a 12 ft. radius curve, a second size radius lock may be used. The radius lock 60 eases installation since an installer can ensure that a desired curvature is achieved by using a certain size radius lock 60. The radius locks 60 also hold the panels at the desired angle during the completion of the assembly of the pool, and during the filling of the pool with water.

Figure 13A:
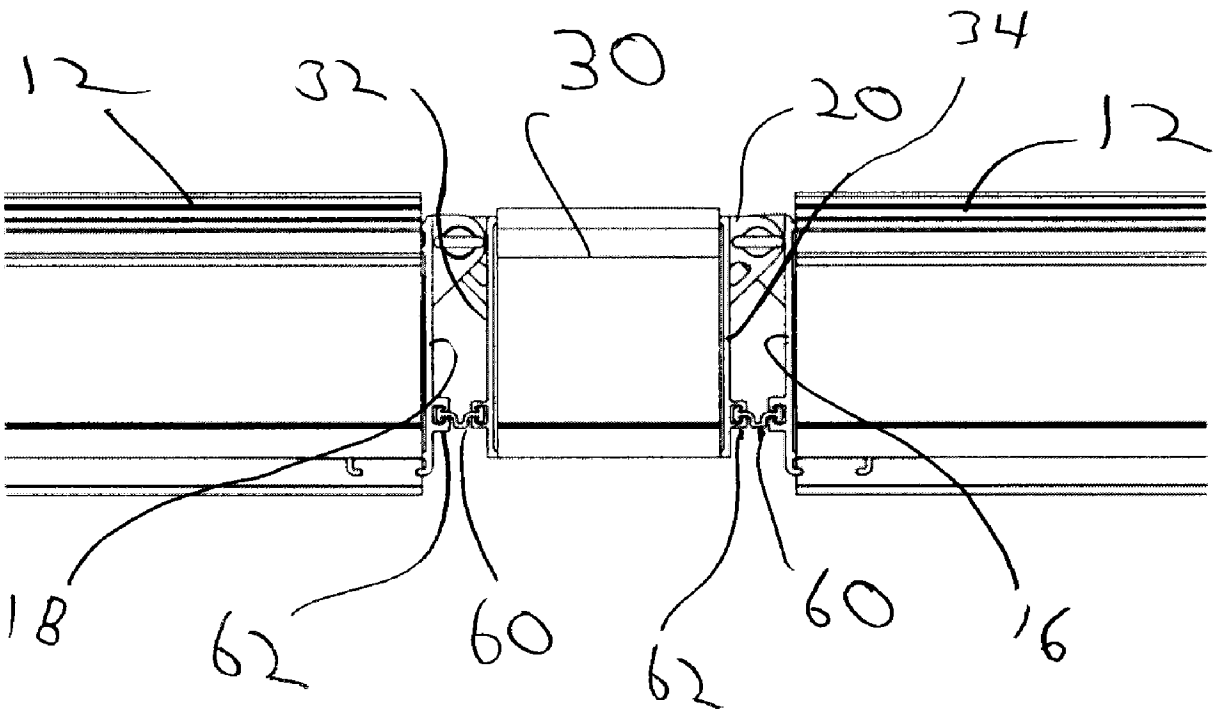
FIG. 13A is a top plan view of panels joined together to form a straight portion of a pool perimeter wall.

The radius locks 60 also may be used to assist in forming straight sections of the pool perimeter wall. With reference to FIG. 13A, a radius lock 60 may be inserted between the securement member 62 on the panel side end and a securement member 62 formed on the opposed sides of the union post 30. The radius locks are sized such that the panels 12 connected to the union post 30 form a straight portion of the pool perimeter wall.

Figure 14:
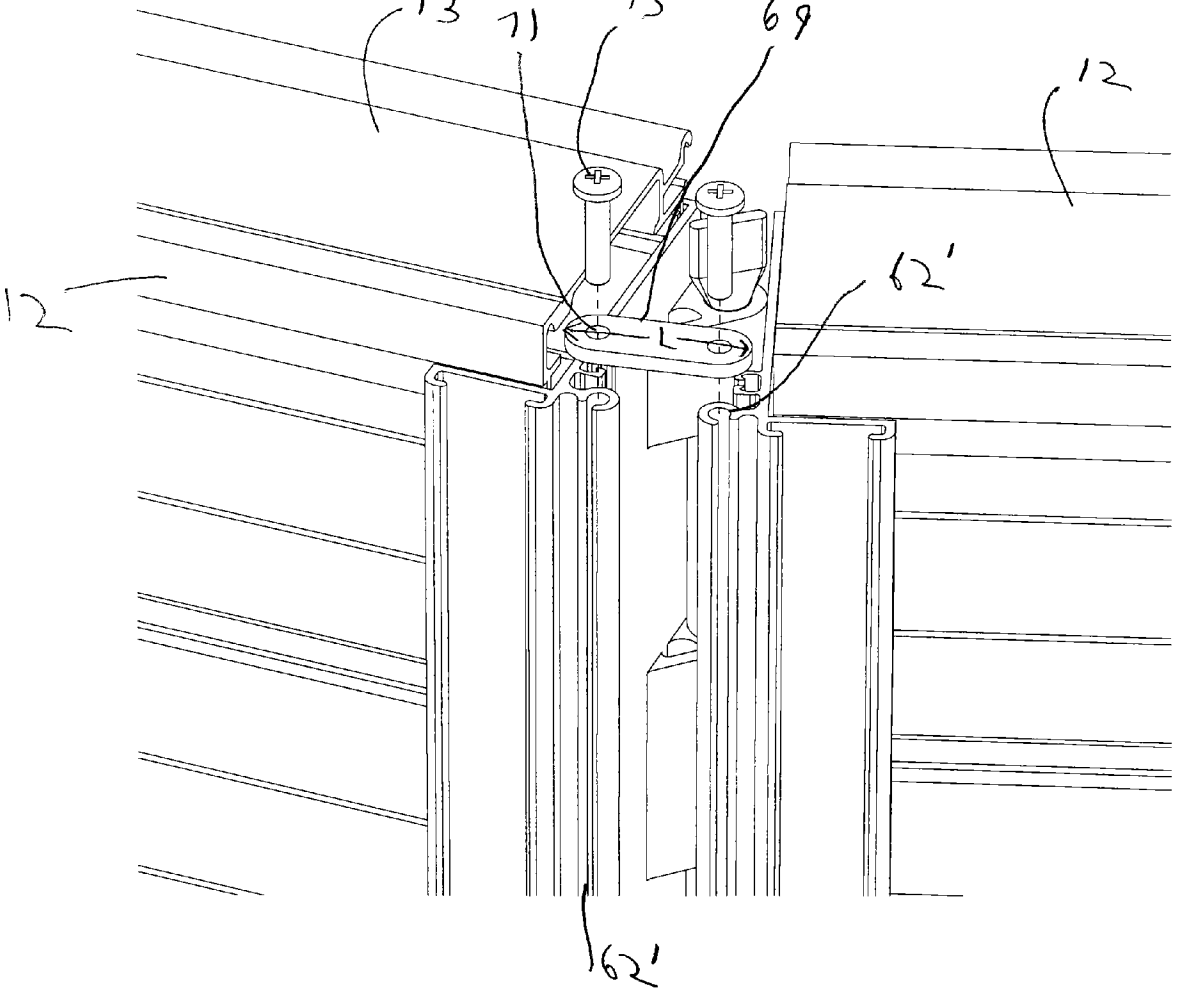
FIG. 14 is a perspective view of an alternative embodiment of a radius lock.

In an alternative embodiment, shown in FIG. 14, the radius lock may include a generally flat bar 69 that extends across and sits on the securement members 62'. The bar 69 may include apertures 71 extending through opposed ends thereof. Fasteners 73 such as screws may extend through the apertures and threadingly engage the securement members 62'. In this embodiment, the length, 1, of the radius lock bar 69 would determine the set angle 0. It is further within the contemplation of the present disclosure that the radius lock could be formed having other configurations.

The panels 12 may be formed to the height desired conforming to the depth of the pool. For example, if a shallow wading-type pool is desired, then the height may be one or two feet. If a full-size pool is desired, then the height may, for example, be three to eight feet. However, it is within the contemplation of the present invention that the height of the panels 12 may be formed to any dimension desired.

Figure 15:
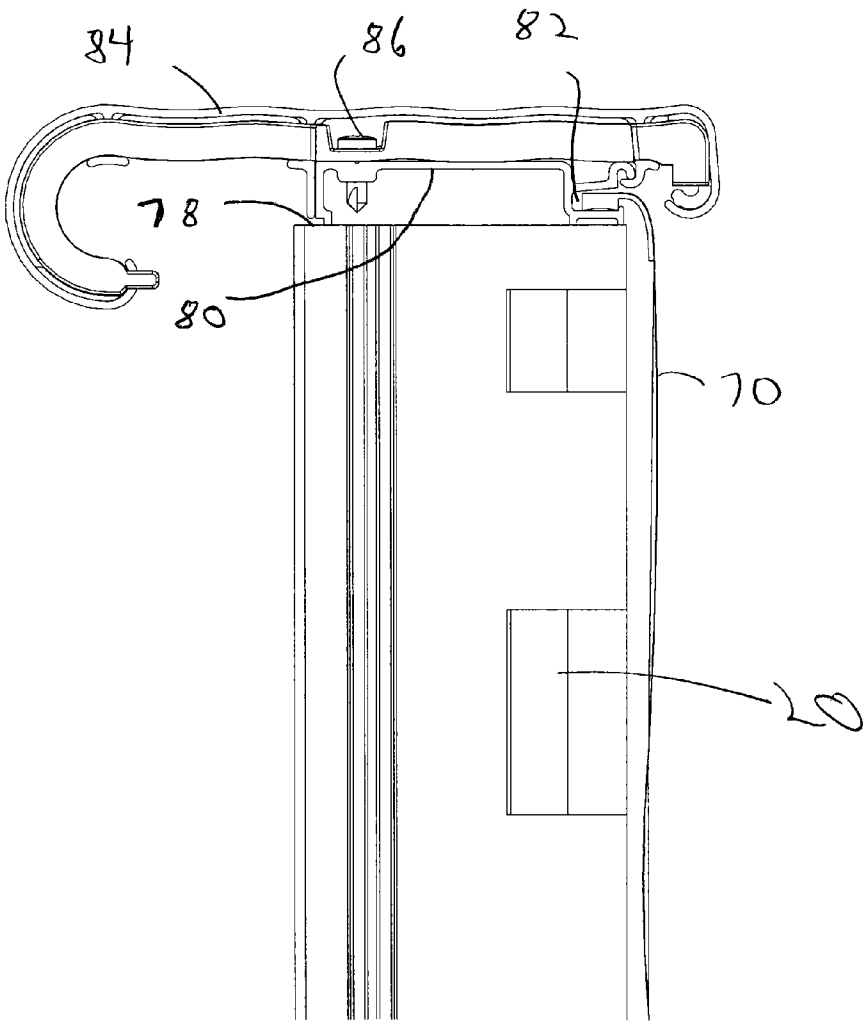
FIG. 15 is a partial side view of a panel having a liner installed.
Figure 16:
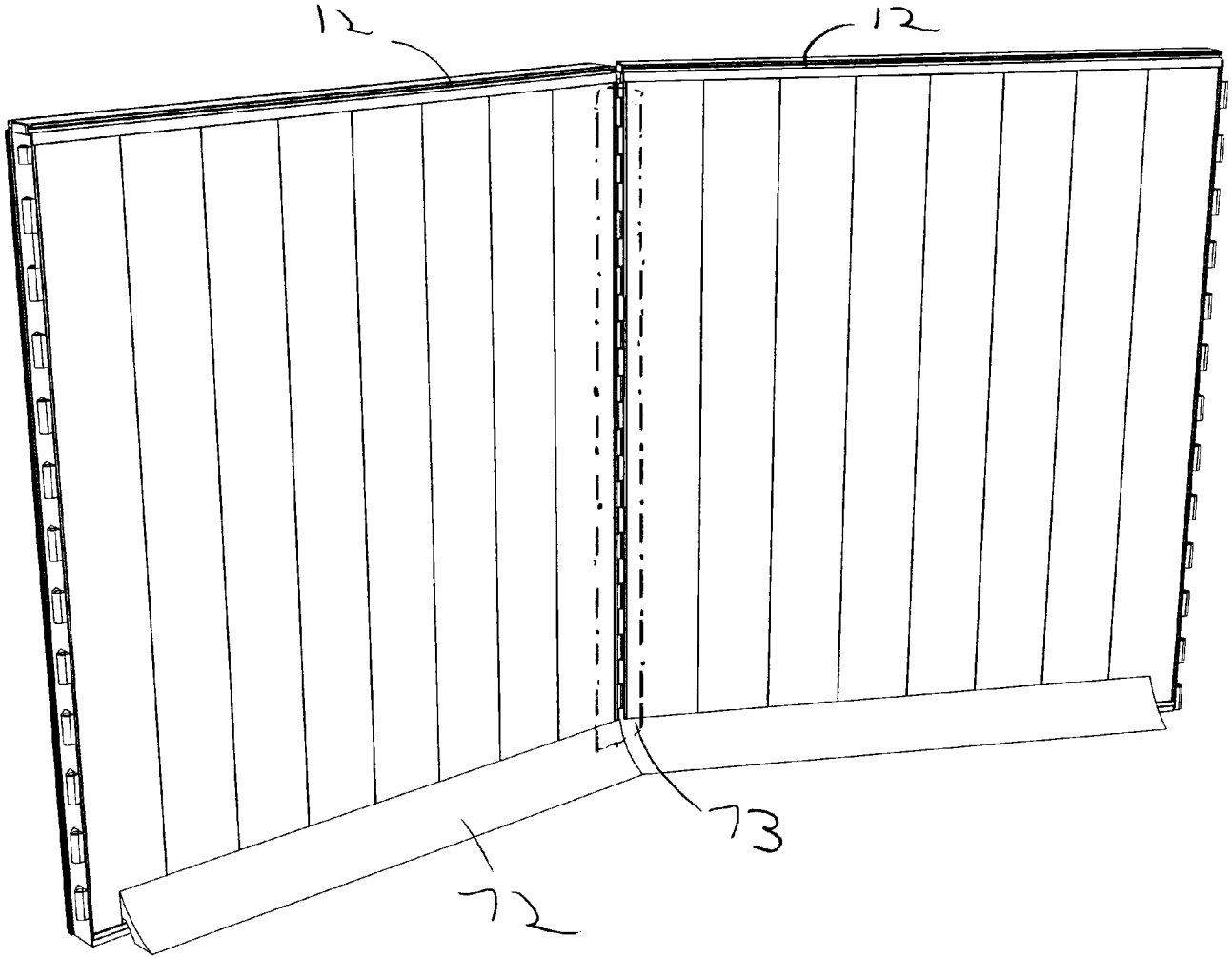
FIG. 16 is a perspective view of wall panels prior to adding a liner.

With reference to FIGS. 15 and 16, once the pool perimeter wall 13 is completed by joining the panels 12, a liner 70 may be installed within the wall 13 in order to form a water-tight container for holding the water. In order to prepare for the installation of the liner, a foam or sand cove 72 may be installed at the base of each panel 12 in order to form a smooth transition between the vertical panel and the horizontal ground surface. In addition, a waterproof tape 73 may be applied along the length of each hinge joint between the panels 12. This permits the liner 70 to be installed using vacuum in a manner known in the art, since the tape prevents ambient air from entering the walls during the vacuum process.

The liner 70 may be supported and secured to the panel top edge 78. A coping member 80 may be secured to the panel top edges 78 and may include a slot 82 therein for receiving an edge of the liner. The coping member 80 may be formed of an extruded material and snapped into place or secured by fasteners in a manner known in the art.

A top ledge 84 may also be added which attaches to coping member 80 which is secured to the panel top edges 78. The top ledge 84 may provide a smooth aesthetically pleasing surface for the top of the perimeter wall 13. Alternatively, the top ledge may be covered by material such as decking or masonry products. In such case, the top ledge may have a configuration to receive such materials. The coping member 80 and top ledge 84 may include projections which interconnect with each other in order to securely attach the two elements together. Fastening hardware such as machine screws 86 may be placed at distances along the ledge in order to securely hold the ledge onto the coping member 80. The modular pool system 10 may include various elements in order to cover the various connections between panels especially when the connection is not straight.

Figure 17:
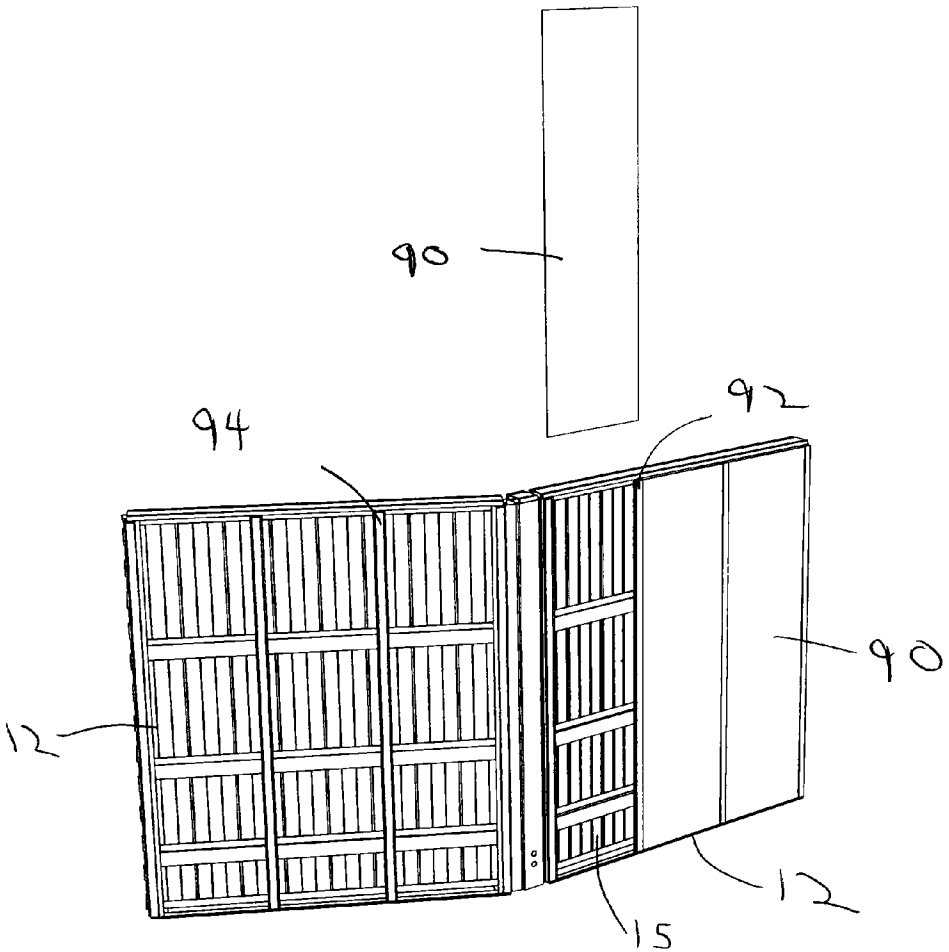
FIG. 17 is a partially exploded view of an outer surface of the perimeter wall with a decorative panel being attached.

With reference to FIGS. 2 and 17, the panel outer surface 15 may be covered with cosmetic outer plates 90 which may extend between the side ends of the panel 12 and snap into place. In a preferred embodiment, the plates 90 may include a plurality of sections which are each individually placed in order to form an outer surface which is aesthetically pleasing. The plates may be held to the panels 12 by locking strips 92. The locking strips 92 may slide into tracks 94 (FIG. 4) formed on the panel outer surface 15. The locking strips include longitudinally extending grooves which capture the side edges of the plates. The plates 90 may be formed of vacuum plastic or painted sheet metal or other material. The joint between the panels may be covered by trim (not shown) in order to provide an aesthetically pleasing appearance.

While the panels 12 described herein are shown forming a perimeter wall of a pool, it is within the contemplation of the present invention that the panels 12 could be joined to form other structures such as retaining walls, barriers, and fences.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A modular pool system comprising:

a plurality of pivotally connected panels disposed side end to side end defining an enclosed pool perimeter wall, the panels being pivotable with respect to each other to form a pool perimeter wall configuration;

a radius lock disposed between adjacent panels to prevent rotational movement there between and thereby fix the adjacent panels at a predetermined angle; and a pool liner being secured to the pool perimeter wall for retaining water within the pool perimeter wall.

2. The system of claim 1, wherein the plurality of panels include an array of spaced projections extending from the side ends of the panels the spaced projections of adjacent panels being connected to form a hinge to permit the panels to pivot in relation to each other.

3. The system of claim 2, wherein the spaced projections of adjacent panels are joined in an interleaving manner and pivotally retained by a hinge rod extending through the spaced projections.

4. The system of claim 2, further including a plurality of union posts disposed between and pivotally connecting together at least a portion of the plurality of panels.

5. The system of claim 4, wherein the plurality of union posts are fixedly secured to a structure upon which the modular pool system sits.

6. The system of claim 4, wherein each of the plurality of union posts include a first and second set of spaced projections operably engagable with the spaced projections on the panels to pivotally interconnect two panels together.

7. The system of claim 1, wherein a first portion of said plurality of panels are pivotally connected directly to each other and a second portion of said plurality of walls are pivotally connected by a union post.

8. The system of claim 1, wherein the panels include side ends having securement members, and the radius lock includes a rigid member having sides secured to the securement members of adjacent panels.

9. The system of claim 8, wherein the securement members include a channel extending in the longitudinal direction between the top and bottom of the panel for engaging the radius lock, wherein the radius lock sides and channels have interlocking profiles such that the radius lock cannot be moved transversely from the panel side ends, wherein the panels are prevented from pivoting with respect to each other.

10. A modular swimming pool perimeter wall comprising:

a plurality of panels aligned side end to side end wherein adjacent panels are pivotally connected, the panels being rotatable relative to each other to form a pool wall configuration; and a radius lock disposed between adjacent panels and interlockingly secured thereto to prevent rotation between adjacent panels to maintain the pool wall configuration.

11. The pool perimeter wall of claim 10, wherein the panels are similarly formed.

12. The pool perimeter wall of claim 10, wherein at least a portion of the panels are pivotally connected directly to each other.

13. The pool perimeter wall of claim 10, wherein the panel side ends include an array of spaced projections extending from the side ends and the spaced projections of adjacent panels engaging each other in an interleaving manner, and a hinge rod extending through the interleaved projections to pivotally retain the adjacent panels together.

14. The pool perimeter wall of claim 10, including a union post including hinge members thereon, the union post pivotally joining together adjacent panels.

15. The pool perimeter wall of claim 10, wherein the pool wall has a generally rounded section and the panels forming the rounded portion are pivotally joined directly to each other.

16. The pool perimeter wall of claim 14, wherein the pool wall has a generally straight section and the panels forming the straight section are joined to each other by the union posts.

17. The system of claim 2, wherein a space between adjacent panels is substantially filled by the spaced projections.

18. The pool perimeter wall of claim 14, wherein a further radius lock is disposed between a side of the union post and an side of an adjacent panel to prevent rotation between the union post and the adjacent panel joined thereto.

* * * * *